US006246172B1

(12) United States Patent
Bizen et al.

(10) Patent No.: US 6,246,172 B1
(45) Date of Patent: Jun. 12, 2001

(54) MAGNETIC CORE FOR RF ACCELERATING CAVITY AND THE CAVITY

(75) Inventors: Yoshio Bizen; Jun Sunakawa; Shunsuke Arakawa, all of Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/379,804

(22) Filed: Aug. 24, 1999

(30) Foreign Application Priority Data

Aug. 25, 1998 (JP) ..... 10-238491
Apr. 5, 1999 (JP) ..... 11-097138

(51) Int. Cl.[7] ..... H01J 25/10
(52) U.S. Cl. ..... 315/5.41; 315/5.42; 361/1; 336/213
(58) Field of Search ..... 315/5.41, 5.42; 361/1

(56) References Cited

U.S. PATENT DOCUMENTS 3,976,950 * 8/1976 Aggus et al. ..... 313/361
5,661,366 * 8/1997 Hirota et al. ..... 315/5.41
5,917,293 * 6/1999 Satifo et al. ..... 315/505

FOREIGN PATENT DOCUMENTS 6-333717 12/1994 (JP) ..... H01F/1/16
9-167699 6/1997 (JP) ..... H05H/7/18

* cited by examiner

*Primary Examiner*—Don Wong
*Assistant Examiner*—Jimmy Vu
(74) *Attorney, Agent, or Firm*—Sughrue, Mion, Zinn, Macpeak & Seas, PLLC

(57) ABSTRACT

There is provided a high-performance magnetic core with a high $\mu'$Qf-value for an RF accelerating. The strip wound magnetic core has a thin strip of nanocrystalline soft magnetic alloy, whose bcc solid solution with an average grain size less than 100 nm has a volume fraction more than 50% of the whole structure of the alloy, and around which an interlayer insulation film at least on one side thereof. A gap is formed in at least a part of a magnetic path of the magnetic core. Stack cores formed by arranging in series a plurality of the magnetic cores are oppositely installed via a high-voltage gap, making it possible to provide an excellent RF accelerating cavity.

14 Claims, 1 Drawing Sheet

MAGNETIC CORE FOR RF ACCELERATING CAVITY AND THE CAVITY

BACKGROUND OF THE INVENTION

The present invention relates to a magnetic core available for an RF accelerating cavity for accelerating charged particles and an RF accelerating cavity in which the magnetic core is used.

In recent years, particle accelerators have been widely used not only in the research of nuclear physics, but also in the development of high technologies in medical science, material science, life science, etc. In synchrotrons, an RF cavity for generating an RF voltage is needed for accelerating ions. Usually, an accelerating cavity with a frequency band of several MHz, in which a magnetic member is used in the resonator of the cavity, is used. A high accelerating voltage is required especially when an accelerating cavity is used in high intensity proton accelerators.

As shown in FIG. 5, an RF accelerating cavity in which the magnetic member is loaded has an accelerating cavity 2 in the middle of a cylindrical vacuum duct 1 and magnetic cores 3*b* and 3*c* are oppositely loaded around the vacuum duct 1. A coaxial transmission line is composed of the vacuum duct 1 and an external cover 5. When a current is fed from an RF power supply 4, an RF voltage is generated in the accelerating cavity by the resonance between the inductance of the magnetic cores and the capacitance of the accelerating cavity and ion beams are accelerated by the RF voltage.

Further, because the orbiting speed increases with increasing accelerating energy of ion beams, it is necessary to increase the resonant frequency of the accelerating cavity with a lapse of time. Usually, a bias power supply 6 is installed and coils are wound on the magnetic cores, thereby controlling the permeability of the magnetic cores in the external magnetic field formed by the bias current in order to increase the resonant frequency.

An Ni—Zn ferrite has been used in the magnetic core for the RF cavity. Recently it has been proposed to use, as an accelerating cavity, magnetic cores formed with a thin strip of nanocrystalline soft magnetic alloy disclosed in JP-A-6-333717 and JP-B2-2856130, in which fine nanoscale grains with a grain size less than 50 nm are formed with at least 50% of the alloy structure of the strip. These techniques are described in a report of "RF Accelerating cavity" by Yoshii, Seminar on High-Energy Accelerators, OHO96(1996), etc.

The performance of a magnetic core for an accelerating cavity is evaluated by the $\mu'$Qf-value in which $\mu'$, the real part of the complex permeability of the magnetic core at an operation frequency f, and the Q-value are used. An excellent accelerating cavity that operates with a small loss and with high efficiency can be obtained by using a magnetic core in which the $\mu'$Qf' value is high. Incidentally, the Q-value is defined by the ratio of the real part $\mu'$ to the imaginary part $\mu''$ of the complex permeability, $\mu'/\mu''$ and the higher this value is, the more excellent the performance of the magnetic core will be.

In the accelerating cavity loaded with Ni—Zn ferrite magnetic cores, it has been difficult to increase the accelerating voltage because of low saturation magnetic flux density and the Curie temperature. When high electric power was applied in order to increase the accelerating voltage, magnetic saturation occurred due to heat generation in the ferrite, resulting in a substantial decrease in the $\mu'$Qf-value and making the operation of the accelerating cavity unstable. Furthermore, when the above nanocrystalline soft magnetic alloy was used, the $\mu'$Qf-value became low because of a low Q-value in the MHz band in which the accelerating cavity operates making it impossible to obtain high performance.

SUMMARY OF THE INVENTION

The present invention was made in order to solve the above problems.

Thus, an object of the invention is to provide a high-performance magnetic core with a high $\mu'$Qf-value for an RF accelerating cavity and the RF accelerating cavity in which the magnetic core is used.

The present inventors earnestly studied to make use of the properties of a thin strip of a nanocrystal soft magnetic alloy in an RF accelerating cavity. As a result, they found out that excellent properties can be obtained by forming the thin strip of the nanocrystalline soft magnetic alloy as a molded magnetic core and providing a gap at least in part of a magnetic path, and finally achieved the present invention.

More specifically, there is provided in the invention a molded magnetic core for an RF accelerating cavity, comprising: a wound strip of a soft magnetic alloy which is provided with an insulating layer on at least one side thereof, and the metal structure of the alloy strip has nanocrystals of bcc-Fe solid solution whose average grain diameter is not more than 100 nm and whose volume fraction is not less than 50% in the metal structure, and at least one magnetic gap. A gap is provided at least in part of a magnetic path of the magnetic core.

Stack cores formed by arranging the magnetic cores in series are oppositely arranged via a high-voltage gap, making it possible to provide an excellent RF accelerating cavity.

DETAILED DESCRIPTION OF PREFERRED EMBODIMENTS

Figure 1:
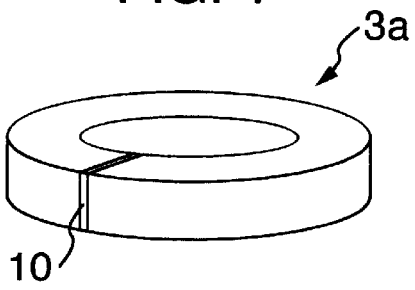
FIG. 1 shows an example of construction of a magnetic core for an RF accelerating cavity related to the present invention.

An example of shape of the magnetic core used in the accelerating cavity of the present invention is shown in FIG. 1.

In FIG. 1, a gap 10 is provided in the magnetic path of a magnetic core 3*a* which is made of wound thin strips of a nanocrystalline soft magnetic alloy.

The reason why the gap is needed in the invention is that the frequency at which magnetic resonance occurs shifts to the higher-frequency side by formation of the gap, thereby making it possible to increase the Q-value the MHz band. This results in an increase in the $\mu'$Qf, showing a high-performance as accelerating cavity.

Figure 2:
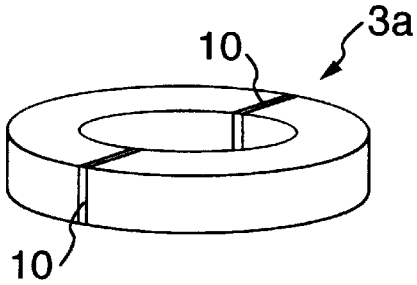
FIG. 2 shows another example of construction of a magnetic core for an RF accelerating cavity related to the present invention.

As a matter of course, two such gaps may be provided to the magnetic core as shown in FIG. 2. More gaps may be also acceptable.

Incidentally, when the distance of the gap or the number of gaps increases, $\mu'$, which is a basic magnetic property, decreases although the Q-value increases. Therefore, it is necessary to make an adjustment as required.

An electrical insulation material such as an epoxy resin can be filled in the gap. Cutting of the magnetic core for providing the cavity can be performed by a way using a grinding wheel, or other ways by means of an electric discharge wire machining, water jet, laser, etc. Although the cut section can be used as cut, eddy-current losses can be further reduced by smoothing the cut section by buffing or chemical polishing.

Because both the saturation magnetic flux density and the Curie temperature are high, the accelerating voltage of an RF accelerating cavity can be easily increased by making the magnetic core with a thin strip of a nanocrystalline soft magnetic alloy whose solid solution with an average grain size than 100 nm having a volume fraction of more than 50% of the whole alloy structure.

As mentioned above, formation of a gap results in a decrease in $\mu'$ and, therefore, it is necessary to use a magnetic material whose $\mu'$ is as high as possible when there is no gap. In other words, it is necessary to use a material with excellent high-frequency characteristics with low magnetostriction and small magnetocrystalline anisotropy. The present inventors decided to use the above thin strip of a nanocrystalline soft magnetic alloy as a magnetic material that meets these conditions.

In forming a gap in the magnetic path, i.e., in cutting the magnetic core, molding the magnetic core of the present invention is indispensable for fixing interlayer-insulated thin alloy strips together, thereby preventing a cut section of the core from damaging by cutting.

Epoxy resins, polyimide resins, phenolic resins, varnishes mainly composed of modified alkyl silicate, silicone resins, etc., are available for such molding. Molding is preferably performed in a vacuum or under a reduced pressure. This enables molding to be uniformly performed without occurrence of defects such as pinholes. After molding, the magnetic core may be cured at room temperature or at 100 to 200° C. for several hours.

Figure 3:
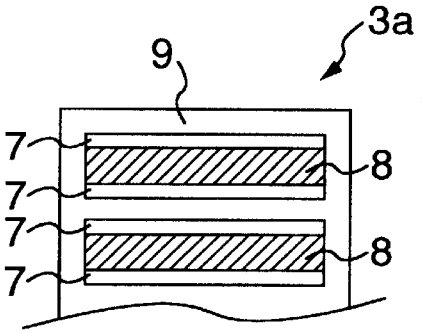
FIG. 3 shows an example of cross-sectional construction of a magnetic core for an RF accelerating cavity related to the present invention.

An interlayer insulation film is desirable in the present invention. FIG. 3 schematically shows a cross-sectional structure of a magnetic core which comprises interlayer insulation films. The magnetic core 3*a* is formed of a thin strip of nanocrystalline soft magnetic alloy 8 provided with an interlayer insulation film 7 and is molded with a resin 9.

It is possible to reduce eddy-current loss by providing an interlayer insulation film at least on one side of the thin strip of the nanocrystalline soft magnetic alloy, thereby avoiding a decrease in $\mu'$ in the MHz band. The thickness of the interlayer insulation film is preferably from 0.5 to 5 $\mu$m and more preferably from 1 to 3 $\mu$m. This is because there may sometimes be cases where the decrease in $\mu'$ due to eddy-current loss becomes remarkable with a thickness of the interlayer insulation film less than 0.5 $\mu$m and where $\mu'$ decreases due to stress in the magnetic core with a thickness of interlayer insulation film exceeding 5 $\mu$m, resulting in a decrease in the performance as an accelerating cavity.

The interlayer insulation film may be made from $SiO_2$, $Al_2O_3$, MgO, etc. In this case, the interlayer insulation film can be formed by following method, applying an alcohol solution containing metallic-alkoxide to the thin alloy strip and drying the same, adhering powders on the thin alloy strip by immersion, spraying or electrophoresis, forming a film by sputtering or evaporating, forming a film on the surface of the thin strip by heat treatment, etc.

The thickness of the thin strip of the nanocrystalline soft magnetic alloy that forms the magnetic core, for example, from 10 to 30 $\mu$m and is preferably from 15 to 25 $\mu$m. This is because there may sometimes be cases where it is difficult to produce a thin strip which is less than 10 $\mu$m in thickness and where, with a thickness of thin strip exceeding 30 $\mu$m, eddy-current losses of magnetic core increase, resulting in deterioration of the performance of the RF accelerating cavity or decrease in toughness of the thin strip.

Further, the packing factor of the magnetic core is preferably from 60 to 80% and more preferably from 65 to 75%. A high-performance magnetic core for the RF accelerating cavity can be obtained in this range. The packing factor can be defined as the spatial ratio of the volume occupied by the magnetic body only to the apparent volume of the magnetic core. This is because there may sometimes be cases, with a packing factor less than 60%, the magnetic core will be difficult to produce, with a packing factor exceeding 80%, the eddy-current losses of magnetic core increase, resulting in a decrease in the performance of the RF accelerating cavity.

A thin strip of the nanocrystalline soft magnetic alloy may preferably comprise Fe as a primary element, at least one element selected from Cu and Au, and at least one element selected from the group consisting of Ti, V, Zr, Nb, Mo, Hf, Ta and W as essential elements, from which the magnetic core of the invention is formed. For example, an Fe—Cu—Nb—Zr—Si—B alloy, an Fe—Cu—Nb—Zr—Si—B alloy, an Fe—Mo—B alloy, an Fe—Nb—B alloy, an Fe—Zr—B alloy, an Fe—Cu—Zr—B alloy and an Fe—Nb—Al—Si—B alloy, which are disclosed in JP-A-4-4393, can be available for the invention.

One example method of producing the magnetic core of the invention is described below.

First, a thin strip of an amorphous alloy is produced from a molten alloy having the above mentioned chemical composition by the liquid quenching method such as the single-roller process. Although the thin strip of the amorphous alloy may comprise a crystalline phase, it is desirable that the alloy as quenched has a mostly single amorphous phase in order to uniformly form nanoscale grains by subsequent heat treatment.

Next, after forming an interlayer insulation film by the above mentioned method, the thin strip of the amorphous alloy is wound to produce the magnetic core, and subsequently be subjected to heat treatment.

The heat treatment is indispensable for obtaining a nanocrystalline structure according to invention in which bcc solid solution with an average grain size of less than 100 nm has a volume fraction more than 50% in the whole alloy structure.

The heat treatment temperature and time, which depend on the size of the magnetic ore or the chemical composition of the thin alloy strip are generally from 450 to 700° C. and from about 5 minutes to about 24 hours, respectively, and are preferably from 500 to 600° C. and from 20 minutes to 6 hours, respectively. This is because, in the case less than 450° C., crystallization is hardly to occur, and because, in the case of the temperature exceeding 700° C., there is formation of non-uniform coarse grains.

If the heat treatment time is shorter than 5 minutes, it is difficult to obtain a uniform temperature over the whole magnetic core and $\mu'$ is liable to vary. If the heat treatment time is longer than 24 hours, not only productivity is bad, but also magnetic properties are liable to be deteriorated due to excessive grain growth and formation of non-uniform morphology grains. Vacuum, an inert gas atmosphere of nitrogen, argon, hydrogen, etc., and a reducing gas atmosphere are preferable for the heat treatment. However, the heat treatment may be also carried out in an oxidizing atmosphere as in air. Cooling may be selected optionally from air cooling, or cooling in a furnace.

Heat treatment can be also performed in a magnetic field of AC or DC. Magnetic properties of the core can be improved by controlling magnetic anisotropy thereto by heat treatment in a magnetic field. It is unnecessary to apply a magnetic field in the whole period of heat treatment and it is good enough to apply a magnetic field only in the period during which the magnetic core is held at a temperature lower than the Curie temperature of the core. Intensity of the applied magnetic field is such a degree as may cause the magnetic core to magnetically saturate. In general, intensity of the magnetic field is preferably more than 1000 A/m.

Figure 4:
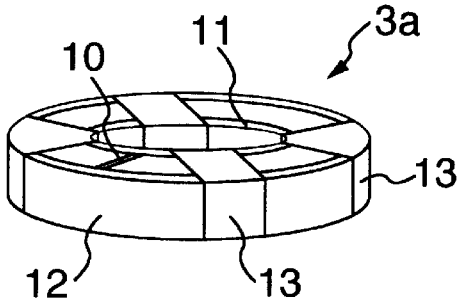
FIG. 4 shows a further example of construction of a magnetic core for an RF accelerating cavity related to the present invention.

After the heat-treated magnetic core is molded with a resin as mentioned above, a gap is formed by cutting a part of the magnetic core. Finally, a spacer is inserted into the gap and the outside of the magnetic core is fastened with a nonmagnetic metal band. Especially in the case of a large magnetic core, for example, with the outer diameter over 500 m, in order to prevent deformation due to its own weight, it is desirable, as shown in FIG. 4, to arrange an inner core 11 made of a nonmagnetic metal, an insulator, etc., to fasten the outside of the magnetic with a band 12 made of a nonmagnetic metal, and to reinforce the magnetic core with a supporting plate 13 made of a nonmagnetic metal or an insulator. The nonmagnetic metal may be stainless steel, brass, aluminum, etc. The insulator may be epoxy resins, phenolic resins, fiber-reinforced plastics, ceramics, etc.

In order to prevent heat generation from the magnetic core, it can be cooled by arranging a pipe made of a material with high thermal conductivity, for example, a copper pipe around the magnetic core and causing cooling water to circulate through the pipe.

Figure 5:
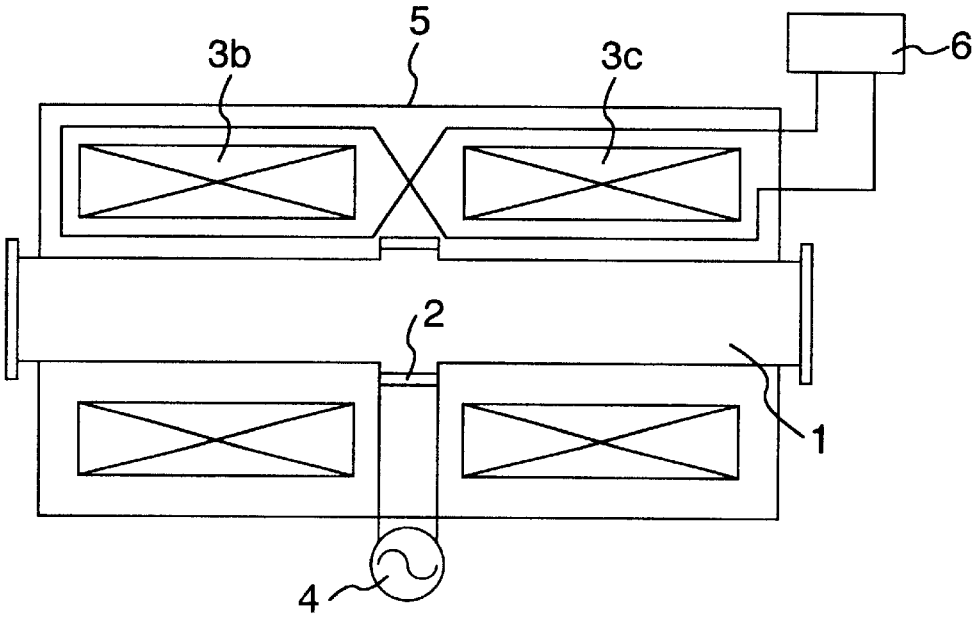
FIG. 5 shows the construction of an RF accelerating cavity related to the present invention.

The RF accelerating cavity of the invention may be such as shown in FIG. 5. It can be fabricated by installing a stack core, which is formed by arranging in series the above magnetic cores for the RF cavity of the invention, as the magnetic core 3*b* and oppositely arranged magnetic core 3*c* formed by a similar stack core via an acceleration gap.

The number of stacks of the magnetic cores 3*a* for the accelerating cavity of the invention that form the magnetic core 3*b* or magnetic core 3*c* used in the accelerating cavity of the invention is optionally selected according to the effective sectional area required of the magnetic core.

When an electric current is fed from a high-frequency power supply 4, a RF voltage is generated in the accelerating cavity by resonance between the inductance of the magnetic cores and the capacitance of the accelerating cavity and ion beams can be accelerated by the RF voltage.

As a matter of course, the orbiting speed increases with increasing accelerating energy of ion beams as with the conventional accelerating cavity and, therefore, it is desirable to increase the resonant frequency of the accelerating cavity with a lapse of time. It is possible to increase this resonant frequency by installing a bias power supply 6 and winding coils on the magnetic cores, thereby controlling the permeability of the magnetic cores in the external magnetic field formed by the bias current.

EXAMPLE 1

A thin alloy strip of $Fe_{ba1}Cu_1Nb_3Si_{16}B_7$ (at %) having a width of 25 mm and a thickness of 18 $\mu$m was produced by the single-roller method. A toroidal magnetic core of 900 mm in outer diameter, 300 mm in inner diameter and 25 mm in height was obtained by applying an interlayer insulation film of $SiO_2$ of 2 $\mu$m in thickness to both surfaces of the thin alloy strip and winding the thin alloy strip while applying and drying the interlayer insulating film. Thereafter, the magnetic core was subjected to heat treatment in a nitrogen atmosphere at 550° C. for one hour without a magnetic field. Fine nanoscale-grains with an average grain size of 20 nm had a volume fraction of 80% in the whole alloy structure in the magnetic core. Next, after the molding of the magnetic core with an epoxy resin under a reduced pressure followed by hardening, a part of the magnetic path was cut by water-jet machining and gap 10 each having a distance of 2 mm were formed in the magnetic path of the magnetic core 3*a* as shown in FIG. 2.

As a comparative example, a magnetic core with no gap in the magnetic path was similarly obtained. Table 1 shows the Q-values and $\mu$'Qf-values of magnetic core measured with an LCR meter at frequencies of 0.5 to 10 MHz.

TABLE 1

| Frequency f | Invention Example | | Comparative Example | |
|---|---|---|---|---|
| (MHz) | Q-value | $\mu$'Qf-value | Q-value | $\mu$'Qf-value |
| 0.5 | 14.69 | $4.10 \times 10^9$ | 1.05 | $8.77 \times 10^8$ |
| 1 | 9.83 | $5.56 \times 10^9$ | 0.80 | $5.77 \times 10^8$ |
| 5 | 3.94 | $7.98 \times 10^9$ | 0.69 | $6.29 \times 10^8$ |
| 10 | 2.63 | $8.73 \times 10^9$ | 0.69 | $8.64 \times 10^8$ |

As is apparent from Table 1, the Q-values in the invention examples are remarkably high compared with those of the comparative examples. Since the $\mu$'Qf-value is high, an excellent RF accelerating cavity which operates with high efficiency is obtained.

Furthermore, in the magnetic core for RF accelerating cavity of the present invention, the saturation magnetic flux density is 1.24 T and the Curie temperature is 570° C., both being high. Therefore, it is possible to increase the accelerating voltage of acceleration cavity.

EXAMPLE 2

A thin alloy strip of $Fe_{bal}Cu_{1.5}Nb_{3.5}Zr_{2.9}Si_{0.3}B_{6.4}$ (at %) having a width of 25 mm and a thickness of 15 $\mu$m was produced by the single-roller method. A toroidal magnetic core of 950 mm in outer diameter, 260 mm in inner diameter and 25 mm in height was obtained by winding the thin alloy strip while applying an interlayer insulation film of MgO to both surfaces of the thin alloy strip. Magnetic cores with a thickness of interlayer insulation film varied between 0 and 7 $\mu$m were made. Thereafter, each magnetic core was subjected to heat treatment in vacuum at 600° C. for one hour without a magnetic field. Fine nanoscale grains with an average grain size of 15 nm had a volume fraction of 90% in the whole alloy structure in the magnetic core.

Next, after the molding of the magnetic core with an epoxy resin in vacuum followed by hardening, a part of the magnetic path was cut by a $CO_2$ gas laser and a gap 10 with a distance of 2 mm was formed in the magnetic path as shown in FIG. 1.

Table 2 shows the real part $\mu$' of the complex permeability of the magnetic cores made with varied thicknesses of interlayer insulation film at a frequency of 1 MHz. As is apparent from the table, magnetic cores with an interlayer insulation film having a thickness of from 0.5 to 5 $\mu$m show high $\mu'$ and they are especially excellent as the magnetic core for the accelerating cavity.

TABLE 2

| Thickness of interlayer insulating film ($\mu$m) | Real number part $\mu'$ of complex magnetic permeability at 1 MHz | Remarks |
|---|---|---|
| 0 | 300 | Comparative Example |
| 0.2 | 470 | Invention Example |
| 0.5 | 500 | Ditto |
| 1 | 515 | Ditto |
| 2 | 520 | Ditto |
| 3 | 515 | Ditto |
| 5 | 510 | Ditto |

EXAMPLE 3

Thin alloy strips of $Fe_{bal}Nb_{7.4}B_{8.4}$ (at %) having a width of 25 mm were produced in varying thicknesses between 8 and 35 $\mu$m by the single-roller method. A toroidal magnetic core of 550 mm in outer diameter, 300 mm in inner diameter and 50 mm in height was obtained by winding the thin alloy strip while applying an interlayer insulation film of $SiO_2$ of 1.8 $\mu$m in thickness to one surface of this thin alloy strip. Thereafter, the magnetic core was subjected to heat treatment in an hydrogen gas atmosphere at 650° C. for one hour without a magnetic field. Fine nanoscale grains with an average grain size of 12 nm had a volume fraction of 95% in the whole alloy structure in the magnetic core.

Next, after the molding of the magnetic core with an inorganic varnish in vacuum followed by hardening, part of the magnetic path was cut by electric discharge wire machining and gap 10 each having a distance of 1 nm were formed in the magnetic path of magnetic core 3*a* as shown in FIG. 1.

Table 3 shows the real part $\mu'$ of complex permeability and Q-values of the fabricated magnetic cores at a frequency of 1 MHz. It is apparent that magnet cores formed of a thin strip of nanocrystalline alloy with a thickness of from 10 to 30 $\mu$m show high $\mu'$ and that they are especially excellent as the magnetic core for the accelerating cavity.

TABLE 3

| Thickness of thin strip ($\mu$m) | Real number part $\mu'$ of complex magnetic permeability at 1 MHz | Q-value at 1 MHz | Remarks |
|---|---|---|---|
| 8 | Unmeasurable | Unmeasurable | Production of a thin strip is difficult. |
| 10 | 1700 | 4.3 | Invention Example |
| 15 | 1500 | 4.7 | Ditto |
| 20 | 1200 | 4.5 | Ditto |
| 25 | 1100 | 4.3 | Ditto |
| 30 | 1000 | 4.2 | Ditto |
| 33 | 890 | 3.0 | Ditto |
| 35 | 810 | 2.6 | Ditto |

EXAMPLE 4

A thin alloy strip of $Fe_{bal}Cu_1Nb_2Si_{7.5}B_{12}$ (at %) having a width of 25 mm and a thickness of 25 $\mu$m was produced by the single-roller method. A toroidal magnetic core of 930 mm in outer diameter, 520 mm in inner diameter and 25 mm in height was obtained by applying an interlayer insulation film of $SiO_2$ to both surfaces of the thin alloy strip and winding the thin alloy strip while applying and drying the interlayer insulation film. Magnetic cores with a packing factor varied between 55 and 85% were obtained core. Thereafter, each magnetic core was subjected to heat treatment in a nitrogen gas atmosphere at 530° C. for one hour while applying a magnetic field of 1000 A/m in the direction of magnetic core height. Fine nanoscale grain with an average grain size of 25 nm had a volume fraction of 80% in the whole alloy structure of the core.

Next, after the molding of the magnetic core with an epoxy resin under a reduced pressure, a part of the magnetic path was cut by water-jet machining and gap 10 each having a distance of 2 mm were formed in the magnetic path of the magnetic core 3*a* as shown in FIG. 2.

Table 4 shows the real part $\mu'$, of complex permeability and Q-values of the fabricated magnetic cores at a frequency of 3 MHz. As is apparent from the table, magnetic cores having a packing factor of from 60 to 80% show high $\mu'$ and Q-values and they are excellent magnetic cores for the accelerating cavity.

TABLE 4

| Packing factor (%) | Real number part $\mu'$ of complex magnetic permeability at 3 MHz | Q-value at 3 MHz | Remarks |
|---|---|---|---|
| 55 | Unmeasurable | Unmeasurable | Production of a thin strip is difficult. |
| 60 | 815 | 4.6 | Invention Example |
| 65 | 810 | 4.5 | Ditto |
| 70 | 800 | 4.4 | Ditto |
| 75 | 790 | 4.4 | Ditto |
| 80 | 750 | 4.0 | Ditto |
| 85 | 620 | 3.3 | Ditto |

According to the present invention, there is provided a high-performance magnetic core for an RF accelerating cavity and the RF accelerating cavity that operate in a stable manner under a high accelerating RF voltage.

What is claimed is:

1. A molded magnetic core for an RF accelerating cavity, comprising: a wound strip of a soft magnetic alloy which is provided with an insulating layer on at least one side thereof, and the metal structure of said alloy strip has nanocrystals of bcc-Fe solid solution whose average grain diameter is not more than 100 nm and whose volume fraction is not less than 50% in the metal structure, and at least one magnetic gap.

2. A magnetic core according to claim 1, wherein the thickness of said insulating layer is from 0.5 to 5 $\mu$m.

3. A magnetic core according to any one of claims 1 or 2, wherein the thickness of said strip is from 10 to 30 $\mu$m.

4. A magnetic core according to claim 1 or 2, wherein the packing factor of said magnetic core is from 60 to 80%.

5. A magnetic core according to claim 1 or 2, wherein said strip of a soft magnetic alloy comprises Fe as a primary component, and at least one element selected from the group consisting of Cu and Au and at least one element selected from the group consisting of Ti, V, Zr, Nb, Mo, Hf, Ta and W as an essential element.

6. A RF accelerating cavity comprising stack cores formed by arranging in series magnetic cores comprising a wound strip of a soft magnetic alloy which is provided with an insulating layer on at least one side thereof, and the metal structure of said alloy strip has nanocrystals of bcc-Fe solid solution whose average grain diameter is not more than 100 nm and whose volume fraction is not less than 50% in the metal structure, and at least one magnetic gap, wherein said stack cores being oppositely arranged via an acceleration gap.

7. A magnetic core according to claim 3, wherein the packing factor of said magnetic core is form 60 to 80%.

8. A magnetic core according to claim 3, wherein said strip of a soft magnetic alloy comprises Fe as a primary component, and at least one element selected from the group consisting of Cu and Au and at least one element selected from the group consisting of Ti, V, Zr, Nb, Mo, Hf, Ta and W as an essential element.

9. A magnetic core according to claim 6, wherein the thickness of said insulating layer is from 0.5 to 5 $\mu$m.

10. A magnetic core according to claim 6 or 9, wherein the thickness of said strip is from 10 to 30 $\mu$m.

11. A magnetic core according to claim 6 or 9, wherein the packing factor of said magnetic core is from 60 to 60 to 80%.

12. A magnetic core according to claim 10, wherein the packing factor of said magnetic core is from 60 to 80%.

13. A magnetic core according to claim 6 or 9, wherein said strip of a soft magnetic alloy comprises Fe as a primary component, and at least one element selected selected from the group consisting of Ti, V, Zr, Nb, Mo, Hf, Ta and W as an essential element.

14. A magnetic core according to claim 10, wherein said strip of a soft magnetic alloy comprises Fe as a primary component, and at least one element selected from the group consisting of Cu and Au and at least one element selected from the group consisting of Ti, V, Zr, Nb, Mo, Hf, Ta and W as an essential element.

* * * * *